US005285245A

United States Patent [19]

Goto et al.

[11] Patent Number: 5,285,245

[45] Date of Patent: Feb. 8, 1994

[54] ELECTROSTATIC TRANSFER TYPE IMAGE FORMING APPARATUS WITH RECORDING MATERIAL GUIDE FOR CHANGING DIRECTION OF RECORDING MATERIAL SEPARATION FROM IMAGE TRANSFER POSITION

[75] Inventors: Masahiro Goto; Takahiro Inoue, both of Yokohama; Koichi Hiroshima, Kawasaki; Koichi Suwa; Tatsunori Ishiyama, both of Yokohama; Manabu Takano, Machida, all of Japan

[73] Assignee: Canon Kabushiki Kaisha, Tokyo, Japan

[21] Appl. No.: 903,129

[22] Filed: Jun. 23, 1992

[30] Foreign Application Priority Data

Jun. 28, 1991 [JP] Japan ..... 3-158481

[51] Int. Cl.[5] ..... G03G 15/14

[52] U.S. Cl. ..... 355/271; 355/282

[58] Field of Search ..... 355/282, 284, 285, 289, 355/290, 295, 271, 273, 274, 276, 308, 309; 219/216; 432/60

[56] References Cited

U.S. PATENT DOCUMENTS

| | | | |
|---|---|---|---|
| 4,338,017 | 7/1982 | Nishikawa | 355/274 X |
| 4,396,273 | 8/1983 | Matsuyama et al. | 355/274 |
| 5,159,394 | 10/1992 | Jinzai | 355/290 |
| 5,172,177 | 12/1992 | O'Dea et al. | 355/285 |
| 5,177,549 | 1/1993 | Ohtsuka et al. | 355/284 |

FOREIGN PATENT DOCUMENTS

| | | | |
|---|---|---|---|
| 0100474 | 6/1984 | Japan | 355/271 |
| 0085576 | 4/1991 | Japan | 355/274 |
| 0131885 | 6/1991 | Japan | 355/274 |
| 0170980 | 7/1991 | Japan | 355/274 |

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus has an image supporting member for supporting a toner image, a transfer rotating member forming a nip with the image supporting member and electrostatically transferring the toner image formed on the image supporting member to a recording material, a fixing device for fixing the toner image to the recording material holding the toner image, and a guide member for guiding the recording material so that the angle between the direction of separation of the recording material from the transfer rotating member and the tangent to the image supporting member at the center of the nip is at least 2° in a direction toward the image supporting member. The fixing device has a fixing rotating member, which contacts the toner image on the recording material and to which a bias of the same polarity as that of the toner is applied, and a pressure rotating member in pressure contact with the fixing rotating member so as to hold the recording material between the fixing rotating member and the pressure rotating member.

10 Claims, 7 Drawing Sheets

ELECTROSTATIC TRANSFER TYPE IMAGE FORMING APPARATUS WITH RECORDING MATERIAL GUIDE FOR CHANGING DIRECTION OF RECORDING MATERIAL SEPARATION FROM IMAGE TRANSFER POSITION

BACKGROUND OF THE INVENTION

1. Field of the Invention

The present invention relates to an electrostatic transfer type image forming apparatus, and particularly to an image forming apparatus such as an electrophotographic printer, a copying machine or the like which uses as a transfer device a transfer roller.

2. Description of the Related Art

Although transfer devices used in electrophotographic printers, copying machines and the like have generally employed a corona transfer process, a roller transfer process has recently been used because it generates little ozone and it has good properties for conveying a recording material, and thus can simplify the carriage means of an image forming apparatus. With regard to fixing devices, these generally comprise a heating roller for use as the fixing device.

However, when an OHP film or dry cardboard (weight 100 g/m$^2$ or more) is used, a toner image on the recording material is electrostatically offset on a fixing roller on the toner side.

Particularly, in a fixing device where for ease of maintenance there is no cleaning member on the heating roller, a fixing ghost occurs due to the re-transfer of the offset toner to the image surface of the recording material at the period of the fixing roller.

Such an offset phenomenon is prevented by applying to the fixing roller a voltage with the same polarity as that of the toner or by grounding the fixing roller through a low-capacity element such as a diode or the like to produce a self bias.

However, when a bias is applied to the fixing roller in an image forming apparatus which uses a transfer roller for electrostatic transfer, there are the following problems.

When an OHP film or a dry cardboard is used as a recording material, the potential of the recording material after transfer depends upon the type and density of the pattern printed, and thus a potential with a polarity reverse to that of transfer charge is sometimes generated. However, when a voltage with a polarity reverse to that of transfer charge is applied to the fixing roller by an electric power source or a diode in order to prevent offset it is necessary to apply a voltage higher than the potential of the recording material after transfer. As a result, a very high voltage (for example, when a negatively charged toner is used, −2 kV or more) is applied to the fixing roller, and leakage to the temperature detection element of a thermistor, to the pressure roller or the like, each of which contact the fixing roller, easily occurs. This causes errors to be produced in the image forming apparatus, and the need for means for preventing the leakage brings about the complication of the apparatus and an increase in the cost thereof.

SUMMARY OF THE INVENTION

It is an object of the present invention to provide an image forming apparatus which can prevent offset on a fixing rotating member.

It is another object of the present invention to provide an image forming apparatus which can prevent leakage from a fixing rotating member to other members.

It is a further object of the present invention to provide an image forming apparatus which can reduce the potential of a recording material after transfer.

In an aspect of the invention there is provided an image forming apparatus comprising an image supporting member and a transfer rotating member forming a nip with the image supporting member for electrostatically transferring a toner image formed on the image supporting member to a recording material. Also provided is a fixing means for fixing the toner image to the recording material, the fixing means having a fixing rotating member, which contacts the toner image on the recording material and to which a bias voltage with the same polarity as that of the toner is applied, and a pressure rotating member in pressure contact with the fixing rotating member so as to hold the recording material between the fixing rotating member and the pressure rotating member. A guide member is provided for guiding the recording material so that a line defined by the direction of separation of the recording material from the transfer rotating member and a line defined by a tangent of the image supporting member at the center of the nip differ by at least 2° with the line defined by the direction of separation closer to the image supporting member than is the line defined by the tangent.

Other objects and characteristics of the present invention will be made clear by the detailed description below with reference to the accompanying drawings.

DETAILED DESCRIPTION OF THE PREFERRED EMBODIMENTS

Figure 1:
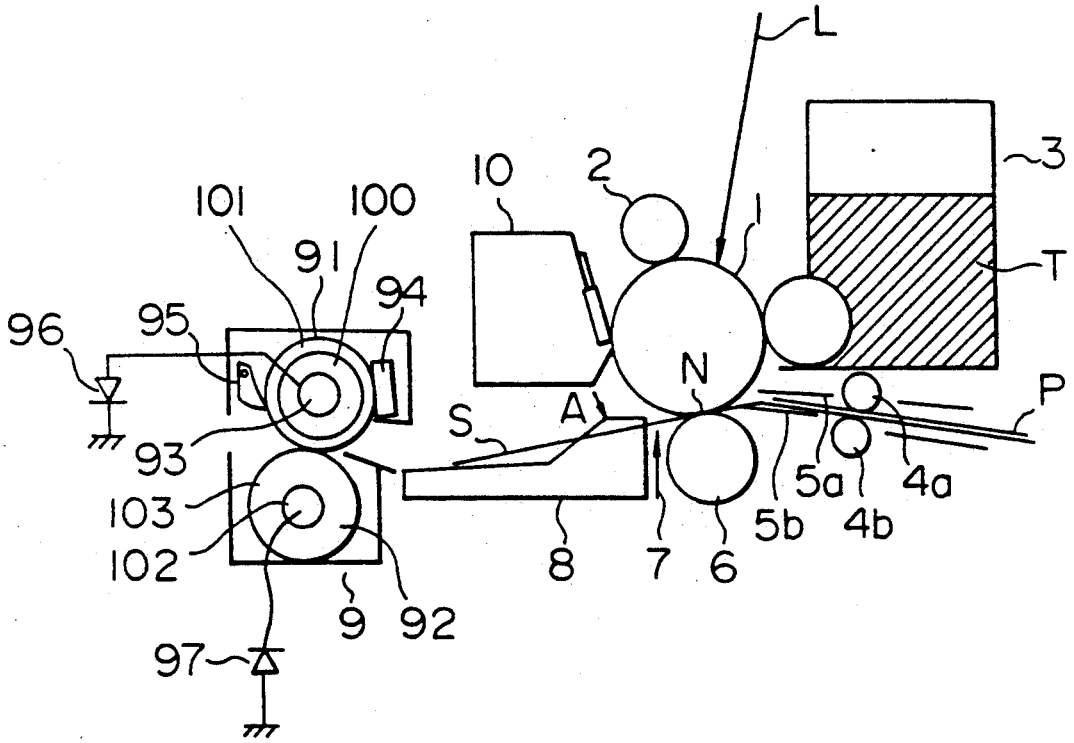
FIG. 1 is a schematic sectional view of a laser beam printer in accordance with an embodiment of the present invention.

FIG. 1 is a schematic sectional view of a principal portion of a laser beam pritner which is an image forming apparatus in accordance with a first embodiment of the present invention.

A photosensitive drum 1 serving as an electrostatic latent image supporting member comprises an organic photoconductive layer (referred to as "OPC" hereinafter) sensitized to infrared rays and a grounded substrate made of aluminum or the like and holding the organic photoconductive layer. After the photosensitive drum 1 is negatively uniformly charged by a charge roller 2, a laser beam L modulated by an image signal is applied to the drum 1 by a laser scanner (not shown) to form a desired electrostatic latent image. The electrostatic latent image is reversely developed by a developing unit 3 containing a negatively chargeable toner powder T so as to be visualized as a toner image. On the other hand, the recording material P supplied from paper feeding means (not shown) is sent to a transfer portion by a pair of carriage rollers 4a, 4b via transfer inlet guides 5a, 5b, and a voltage with a polarity reverse to that of the toner is applied to the recording material P, whereby the toner image is transferred to the recording material P by a transfer roller 6 which forms a nip with the photosensitive drum 1. After excessive transfer charge is removed by a destaticizing needle 7, the recording material P is conveyed over a carriage guide 8. The carriage guide 8 deflects recording material P upward so that it exits the nip between the photosensitive drum 1 and the transfer roller 6 in a direction that is at an angle relative to tangent S, which is the tangent to the photosensitive drum 1 from the center of the contact portion between the transfer roller 6 and the photosensitive drum 1. As used herein, the direction of the separation is measured by the deviation in $\alpha$ degrees from tangent S. The recording material P is then guided to a fixing unit 9 in which the toner image thereon is permanently fixed. The toner remaining on the photosensitive drum 1 after transfer is cleaned off by a cleaner 10, and the same image forming process is repeated.

A detailed description will now be made of the transfer roller 6, the carriage guide 8 and the fixing unit 9, which are principal components of the present invention.

Figure 12:
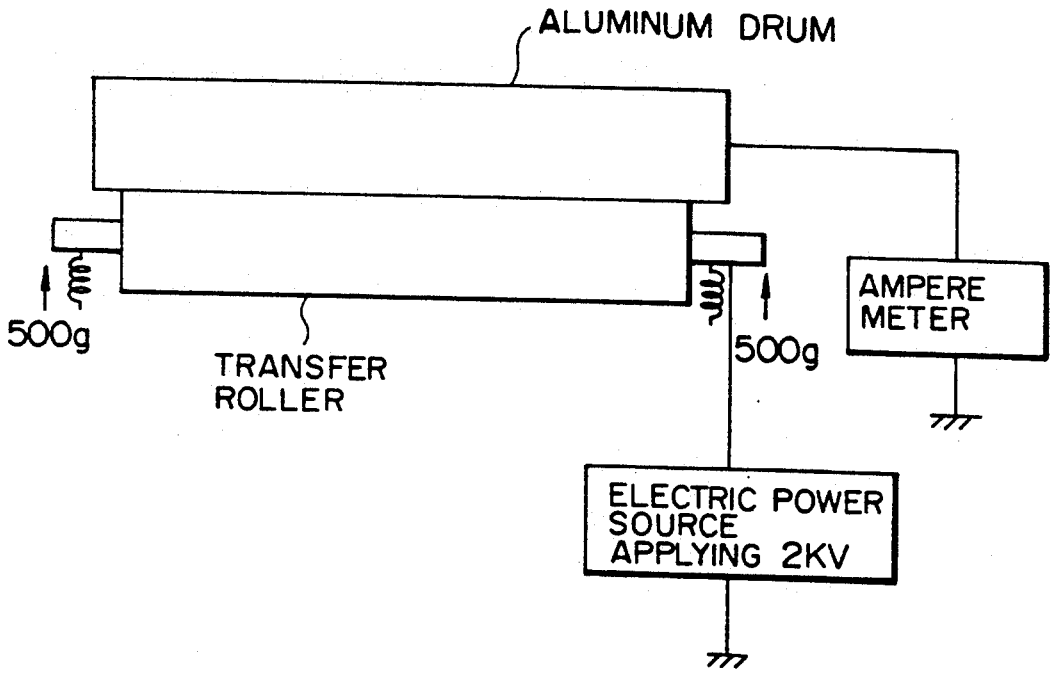
FIG. 12 is a drawing illustrating a method of measuring the resistance of a transfer roller.

The transfer roller 6 is made of a rubber such as urethane, EPDM (ethylene-propylene-diene terpolymer), CR (chloroprene rubber), silicone rubber or the like or of a foam sponge thereof. A roller having a roller hardness of 40 degrees or less (ASKER C 500 g load) is used for preventing the phenomena of character omission and scraping of the photosensitive drum 1 during transfer. It is suitable for the transfer roller 6 to have a resistance value of about $10^7$ to $10^{10}$ as measured by the resistance measuring method shown in FIG. 12. A suitable resistance value of about $10^7$ to $10^{10}$ is required for obtaining a high transfer efficiency when a high-resistance recording material such as an OHP high-resistance resin film or dry paper allowed to stand in a low-humidity environment is used. The mechanism for applying transfer charge to a high-resistance recording material mainly comprises the charge movement caused by discharge from dielectric breakdown of air in the region near the nip portion where the recording material P is slightly separated from the transfer roller 6 according to the Paschen's law. It does not comprise direct charge movement to the recording material in the nip portion formed by the transfer roller 6 and the photosensitive drum 1. As a result, the aforementioned resistance value permits sufficient transfer charge to be obtained by applying a voltage of about 2 kV or more to the transfer roller 6. However, if the resistance of the transfer roller 6 is excessively low, a large amount of current flows from the transfer roller 6 to the photosensitive drum 1 and the point where the transfer roller 6 is in direct contact with the photosensitive drum 1, namely, without the recording material therebetween, thereby damaging the photosensitive drum 1. By contrast, if the resistance of the transfer roller 6 is excessively high, a current hardly flows, thereby producing defective transfer. There is thus an optimum resistance value of $10^7$ to $10^{10}$ Ω for the transfer roller 6. An optimum voltage (2 to 5 KV) is applied to the transfer roller 6 according to the resistance value thereof.

Figure 2:
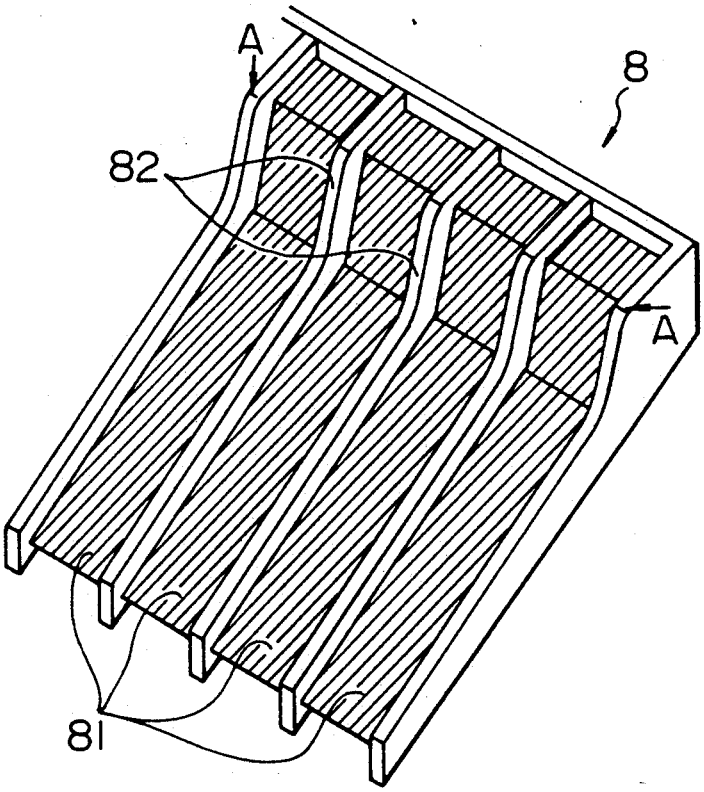
FIG. 2 is a perspective view of a carriage guide.

The carriage guide 8 functions to separate the recording material P in the direction (the direction of the tangent S shown in FIG. 1) of feed by the transfer roller 6 and the photosensitive drum 1 and in the direction against the gravity which is at an angle with respect to the direction of the tangent S on the side of the photosensitive drum 1. The top A of the carriage guide 8 is thus disposed nearer the photosensitive drum 1 than the tangent S shown in FIG. 1. The carriage guide 8 also functions to control the movement of the recording material P so as to prevent the recording material P from contacting with, for example, the cleaner 10 during the movement of the recording material P from the transfer portion to the fixing portion. This function is important for a system in which the direction of separation of the recording material P is close to the side of the photosensitive drum 1, as in the present invention, because the trailing end of the recording material P easily approaches the cleaner 10. The function of the carriage guide 8 to electrostatically adsorb the recording material P is most effective for regulating the movement of the recording material P. This function is obtained by using as the carriage guide 8 a grounded conductive member such as a sheet metal member or the like. In order to prevent the transfer charge from escaping due to the direct contact of the rear surface of the recording material P with the conductive member after transfer, and prevent adverse effects on offset or turbulence of the image transferred, the carriage guide 8 also has ribs 82 made of a resin (high-resistance material of $10^{10}$ Ω·cm or more) such as ABS, polycarbonate or the like, for example, as shown in FIG. 2, a sheet metal 81 being provided between the respective ribs 82. The sheet metal 81 is preferably extended to a portion nearer the photosensitive drum 1 than the top portion A of the carriage guide 8 so that the trailing end of the recording material P can be brought sufficiently close to the carriage guide 8. This can prevent the trailing end of the recording material P from approaching the cleaner 10.

Figure 3A:
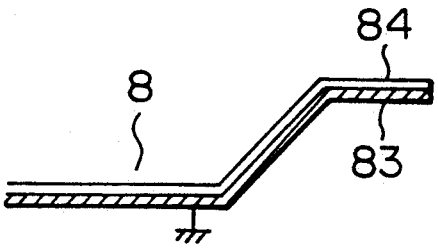
FIGS. 3*a* and 3*b* are schematic sectional views of other carriage guides.
Figure 3B:
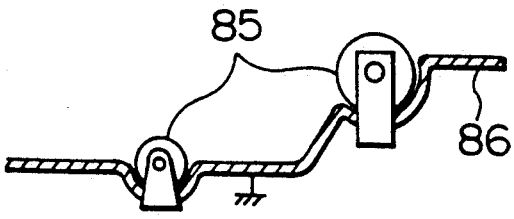

The carriage guide 8 may have a construction other than the construction shown in FIG. 2. For example, as shown in FIG. 3a, a film 84 (for example, PET (polyethylene terephthalate) film, FEP (tetrafluoroethylene-hexafluoropropylene copolymer) film, or PVdF (polyvinylidene fluoride) film) having a resistance of $10^{10}$ Ω·cm or more may be pasted on the sheet metal 83. Alternatively, as shown in FIG. 3b, a rotating member 85 made of ABS resin, polycarbonate resin or the like is disposed on each of the portions carriage guide 8 in contact with the recording material P, and a sheet plate 86 may be disposed on portions which do not contact with the recording material P.

The fixing unit 9 comprises a heat fixing roller 91 having a metal core 100 of Al, Sus or the like, and a releasing layer 101 of PFA (polyfluoroethylene-perfluoroalkoxy copolymer), PTFE (tetrafluoroethylene resin) or the like coated to a thickness of 10 to 50 μm on the metal core 100, and a pressure roller 92 having a metal core 102 of Sus, iron or the like and a heat resistant elastic layer 103 of silicone rubber, silicone sponge or the like. The heat fixing roller 91 is heated by a heating member 93 such as a halogen heater which is provided therein, and the surface temperature of the heat fixing roller 91 is controlled to a predetermined value by the signal output from a surface temperature detection element 94, such as a thermistor. When the recording material P supporting an unfixed negatively charged toner image is conveyed to the fixing unit 9 in such a manner that the unfixed toner faces the heat fixing roller 91, the recording material P is conveyed while being held between both rollers to fix the toner image.

In this embodiment, the metal core 100 of heating roller 91 is grounded through a low-capacity diode 96 provided in a direction which inhibits the movement of charge with the same polarity as that of the toner so as to prevent offset. However, since the direction of separation of the recording material P from the transfer roller 6 is controlled, a low voltage of −300 v or less induced in the heating roller 91 can completely prevent the occurrence of offset in an OHP film or a dry cardboard. The reason for this will be described below. It is desirable that the pressure roller 92 has conductivity so as not to generate a high potential with the same polarity as that of the toner by frictional electrification with the recording material P, and pressure roller 92 is configured so that the transfer charge present in the rear surface of the recording material P does not leak. In addition, the pressure roller 92 must be configured so as to control at least the movement of charge with the same polarity as that of the transfer charge and prevent a potential with the same polarity as that of the toner from occurring on the surface of the pressure roller 92 within the region from the surface of the pressure roller 92 to the ground plane. Structures effective for the pressure roller 92 having the above functions include the following:

1) A conductive elastic layer provided on the metal core and grounded through a low-capacity rectifying device such as a diode (the diode functions to inhibit the flow of a current with the same polarity as that of transfer charge to the ground plane).
2) A conductive elastic layer provided on the core metal, and a high-resistance layer comprising a PEA tube, a FEP tube or the like and a releasing layer are coated to a thickness of 20 to 100 μm on the conductive elastic layer, the metal core being grounded or grounded through a diode as in structure 1).
3) A conductive or high-resistance elastic layer provided on the metal core, and a conductive layer (for example, a conductive PFA tube, FEP tube or the like) provided on the elastic layer, the surface conductive layer being grounded through a diode.

This embodiment employs structure 2) or 3) in view of the durability (not stained with toner for a long time) of the pressure roller 92 and the slipperiness (frictional electrification is not easily produced by the recording material P) of the recording material P. However, structure 2) is preferred because of the ease of the production thereof and the difficulty in leakage of the voltage applied to the heating roller 91, and the pressure roller 92 having the PFA tube of 50 μm thick coated on a conductive silicone rubber layer is used. The metal core of the pressure roller 92 is grounded through a diode 97 in order to increase the function of preventing the occurrence of offset.

When the pressure roller 92 is configured as described above, the potential generated by frictional electrification between the pressure roller 92 and the recording material P in the electrical field acting between the recording material P and the heating roller 91 in the heat fixing unit can be disregarded. Therefore the voltage induced in the heating roller 91 is determined only by the charge possessed by the recording material P after transfer. Further, the distance between the transfer nip and the fixing nip in the direction of conveyance of the recording material P is shorter than the length of a recording material of the maximum size.

The function and effects of the embodiment are described below.

It has been found that the offset phenomenon depends upon the potentials induced in the heating roller 91 and the pressure roller 92. The potential depends upon the charge possessed by the recording material P after transfer, if the frictional electrification between the pressure roller 92 and the recording material P is disregarded. In the case of diode connection like this embodiment, the more the offset is difficult to occur, the lower the negative potential generated in the heating roller 91 and the higher the positive potential induced in the pressure roller 92. In this embodiment, since positive charge is supplied to the recording material P from the transfer roller 6, and since the main charge possessed by the recording material P is thus positive, a positive potential is induced in the pressure roller 92, and substantially no potential is induced in the heating roller 91. As a result, offset does not occur. However, in a conventional apparatus, when an OHP high-resistance resin film or high-resistance cardboard is used as a recording material, the negative charge on the surface of the recording material which supports a toner image is increased due to releasing discharge between the photosensitive drum and the recording material after transfer. When the image is fixed to the recording material, since the negative charge of the recording material does not go to ground through the diode 96, the potential induced in the heating roller 91 is lower than that of the recording material P. In addition, a potential of −2 KV or more is sometimes induced in the heating roller 91 depending upon the printed pattern on the recording material after transfer. In this case, since the higher the potential induced in the heating roller 91, the more the leakage current (the current flowing in the direction opposite to the direction of flow of usual current in the diode) of the diode 96, the potential induced in the heating roller 91 is further reduced to a value lower than that of the recording material P. As a result, offset significantly occurs. In addition, since the potential of the heating roller 91 becomes high, for example, leakage occurs to the thermistor 94 and the conductive silicone rubber layer of the pressure roller 92. In order to prevent offset and an increase in the potential of the heating roller 91, the charge possessed by the recording material P after transfer must be controlled. It has been found that the control of the direction of separation of the recording material P from the transfer roller 6 enables the charge possessed by the recording material P to be controlled, thereby obtaining a desired value of the potential induced in each of the heating roller 91 and the pressure roller 92.

Figure 4:
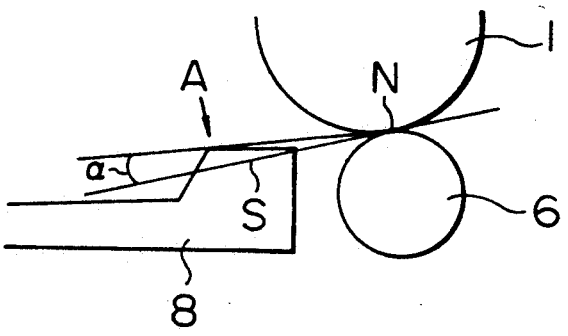
FIG. 4 is an enlarged view of the transfer portion of the embodiment shown in FIG. 1.
Figure 5:
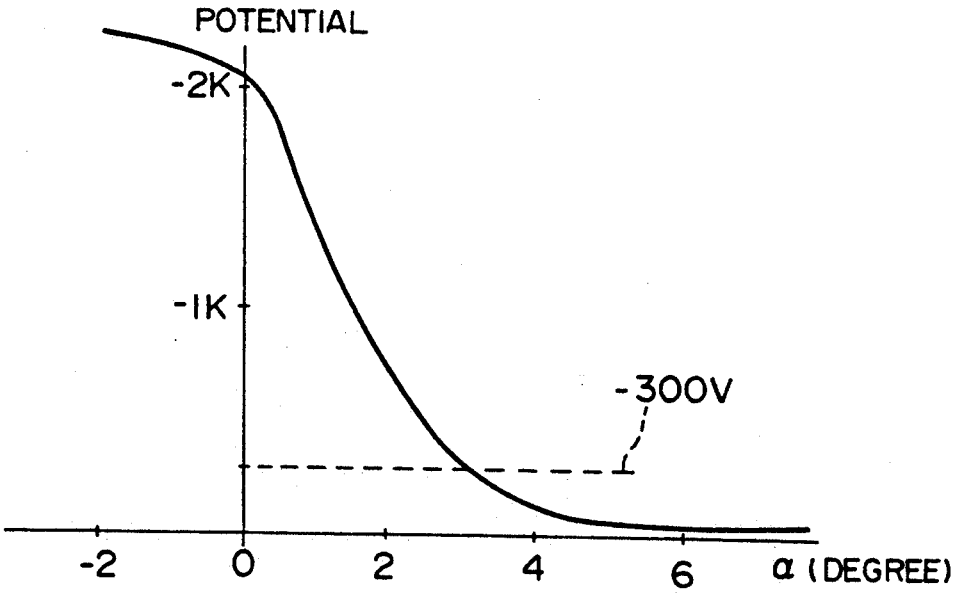
FIG. 5 is a graph showing the relation between the direction of separation of a recording material and the potential induced in a fixing roller.

FIG. 4 is a partially enlarged schematic sectional view showing the photosensitive drum 1, the transfer roller 6 and the carriage guide 8. As previously noted, the direction of separation is defined in terms of the deviation in degrees of the path of recording material P from tangent S. $\alpha$ (degree) is a measure of the angle between the tangent S to the photosensitive drum 1 at the nip center point N of contact between the transfer roller 6 and the photosensitive drum 1 and the line connecting the top A of the carriage guide 8 and the contact point N. FIG. 5 is a graph showing the correlation between the $\alpha$ (degree) of separation of the recording material P shown in FIG. 4 and the potential induced in the heating roller 91 when fine vertical lines are printed on an OHP film. The reason for printing fine vertical lines on the OHP film is that a highest negative potential was experimentally observed when vertical lines were printed (a pattern printed by 2 to 5 dots with a print density of 300 dpi, with a margin of 3 to 15 dots). As seen from the graph, a negative potential decreases, and a positive potential appears as the direction $\alpha$ of separation increases. If the potential of the heating roller 91 is $-600$ V or less, substantially no leakage occurs toward the thermistor 94 and the pressure roller 92. Even if leakage occurs toward the thermistor 94, a potential of $-600$ V or less causes no error in the image forming apparatus. The angle of the direction of separation is thus preferably 2° or more. The investigation performed by the inventors also showed that if the potential induced in the heating roller 91 is $-300$ v or less, no offset occurs. As seen from the graph shown in FIG. 5, therefore, the offset can be completely prevented when the angle $\alpha$ of the direction of separation is at least 3°.

Figure 6:
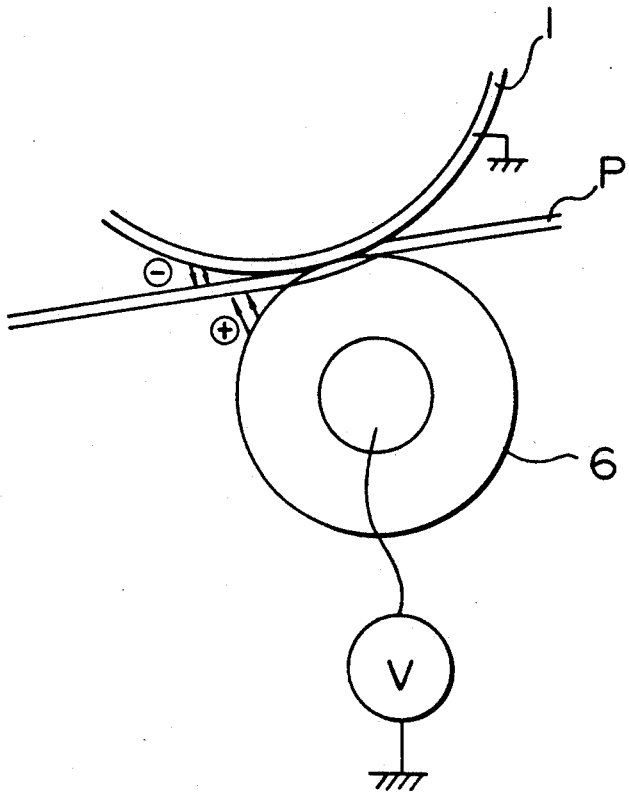
FIG. 6 is a schematic drawing showing the movement of a recording material from a transfer roller and a photosensitive drum.
Figure 7:
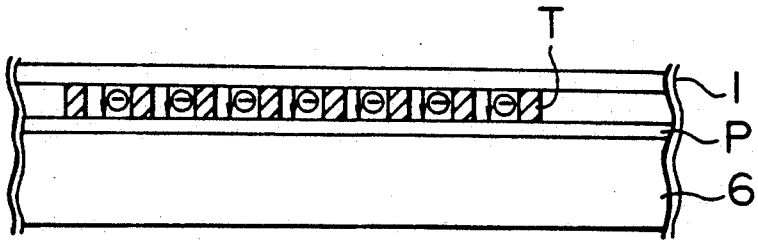
FIG. 7 is a schematic drawing showing the movement of charge from a transfer roller and a photosensitive drum to a recording material.

In this way, it is thought that the charge of the recording material P after transfer can be controlled due to the following:

FIG. 6 is a drawing schematically showing movement of the charge from the transfer roller 6 to the recording material P. The transfer charge is moved from the transfer roller 6 to the recording material P in the portion where the recording material P is separated from the transfer roller 6, as described above. On the other hand, negative charge is moved from the photosensitive drum 1 to the recording material P due to the voltage possessed by the transfer roller 6 and the potential generated by the positive charge applied to the recording material P in the portion where the recording material P is separated from the photosensitive drum 1. As a result a positive charge is generated on the rear surface of the recording material P and a negative charge is generated on the front surface thereof. With a general recording material, the positive and negative charges are moved in the direction of the thickness of the recording material and neutralized, leaving any excess positive charge remaining. However, with an OHP film or high-resistance cardboard, the negative charge remains on the surface of the recording material P because the charge cannot move in the direction of the thickness of the recording material. With reference to FIG. 7, when the toner image T comprises vertical lines arranged with a small period present, a gap is produced between the photosensitive drum 1 and the recording material P due to the effects of the toner image T, even if the recording material P is pressed against photosensitive drum 1 by the transfer roller 6, and the negative charge moves from the photosensitive drum 1 to the recording material P by the attractive force of the positive voltage applied to the transfer roller 6. As a result, positive and negative charges are respectively present on the front and rear surfaces of the recording material P, and when the negative charge is excessive, a negative potential is induced in the heating roller 91.

In the present invention, the positive and negative charges are generated so that the positive charge is always excessive regardless of the print pattern. This is achieved by controlling the direction of separation of the recording material P from the transfer roller 6. The electrostatic capacity of the recording material P in the region where charge is actually moved increases, and the amount of the transfer charge moved in the region increases as the direction of separation of the recording material P from the transfer roller 6 approaches the photosensitive drum 1. On the other hand, viewing the recording material from the side of the photosensitive drum 1, since the direction of the separation is further from the transfer roller 6, the electrostatic capacity decreases, and the negative charge moved to the recording material P from the photosensitive drum 1 consequently decreases. As a result, the positive charge supplied to the recording material P is sufficiently greater than the negative charge. In the present invention, this point is experimentally confirmed. The recording material P is separated in the direction at an angle of at least 3° with respect to the tangent S (shown in FIGS. 1 and 4) further from the transfer roller 6 and closer to the photosensitive drum 1, thereby preventing the offset. This also prevents the leakage phenomenon because the potential induced in the heating roller 91 is low.

The diode 96 of this embodiment is described below.

It is necessary for the diode 96 provided on the heating roller 91 to be capable of possessing substantially the same potential (at least in the negative direction only) as that of the recording material P when the recording material P contacts with the heating roller 91, and the capacity is thus preferably extremely low, and preferably, the heating roller 91 has a capacity of 100 PF or less relative to the ground plane.

Figure 8:
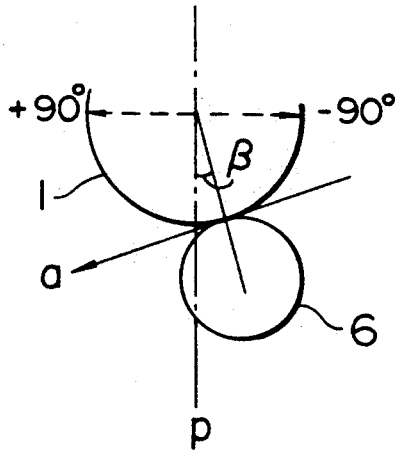
FIG. 8 is an enlarged sectional view of the transfer section of the embodiment shown in FIG. 1.

The direction of the separation is preferably controlled by the carriage guide 8 to be kept constant. For example, if the recording material P partially approaches and separates from the photosensitive drum due to the unstable movement caused by the stiffness of the recording material during the carriage of the recording material P, the potential induced in the heating roller 91 easily becomes unstable. Since offset is easily produced by an abrupt change in the potential of the heating roller 91, the above phenomenon is undesirable. Most effective means for stabilizing the direction of the separation of the recording material P utilizes the action of gravity. Assuming that the direction of movement of the recording material is a, as shown in FIG. 8, the angle $\beta$ between the vertical line P and the line connecting the center of the transfer roller 6 and the center of the photosensitive drum 1 is within the range of from $-60°$ to $+60°$, and preferably $-30°$ to $+30°$, whereby the stable direction of separation can be constantly obtained by the means for controlling the direction of separation.

EMBODIMENT 2

Figure 9:
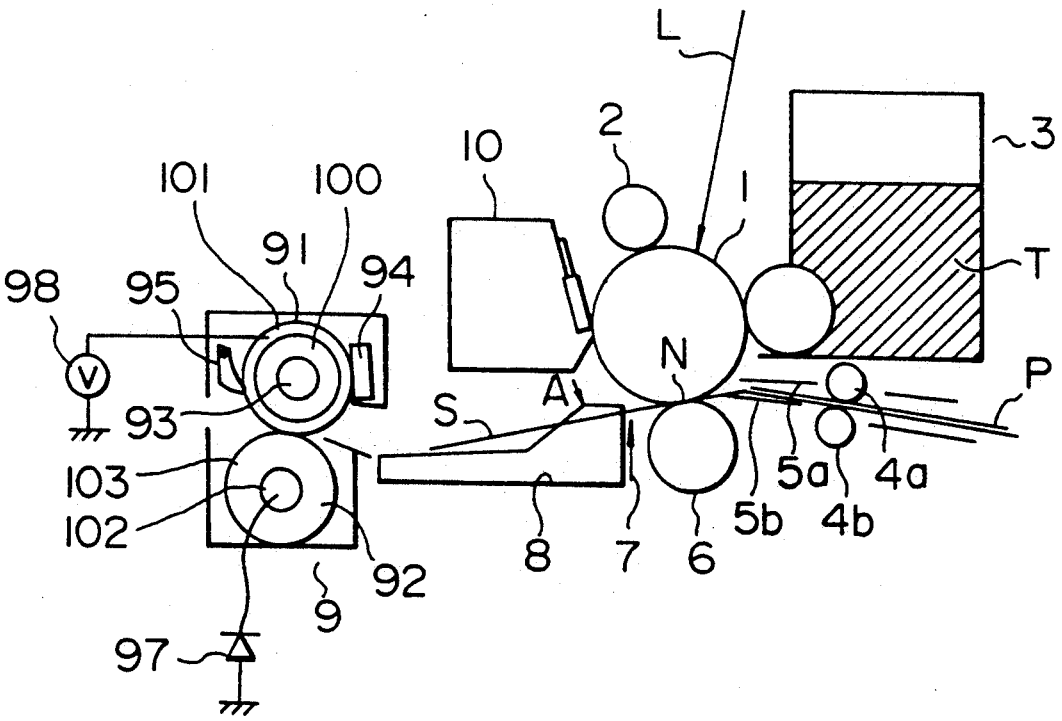
FIG. 9 is a schematic sectional view of a laser beam printer in accordance with another embodiment of the present invention.

FIG. 9 is a schematic sectional view of a principal portion of a laser beam printer in accordance with a second embodiment of the present invention.

Since the construction and operation of the principal portion is the same as for the corresponding portions of the first embodiment, they are not described below. This embodiment is characterized in that a voltage with the same polarity as that of the toner is applied to the heating roller 91 by an electric power source 98. When a voltage is applied to the heating roller 91, a voltage is applied so as to constantly produce an electric field in a direction of repulsion toward the toner against the potential of the recording material P produced in the heat fixing device in accordance with the charge possessed by the recording material P, thereby preventing the offset. When a diode is provided on the heating roller 91, as the above-described embodiment, or when the heating roller 91 is floated, a voltage with the same potential as that induced in the heating roller or higher than that in the negative direction is applied to the heating roller 91 when the recording material P is passed through the heat fixing unit 9, thereby preventing offset.

A description is made with reference to the graph shown in FIG. 5 of the above embodiment. If the direction of separation of the recording material P from the transfer roller 6 is on the tangent S or goes away from the photosensitive drum 1, offset cannot be prevented unless a voltage of −2 KV or more (for example, −2.5 to −3 KV) is applied to the heating roller 91. However, the application of such a high voltage to the heating roller 91 causes problems with respect to the above-described leakage and with respect to a transfer failure (caused by flow of a transfer current into the heating roller 91 from the transfer roller 6), as well as winding of the recording material P on the heating roller 91 due to electrostatic adsorption force, particularly when the recording material P is absorbing water under conditions of high temperature and high humidity. The voltage applied to the heating roller 91 must be −500 V or less in order to prevent the occurrence of the problems. As a result, as seen from the graph shown in FIG. 5, it was found that the direction of the separation of the recording material P should be controlled to a direction at an angle of at least 2.5° with respect to the tangent S on the side of the photosensitive drum 1.

When a voltage is applied to the heating roller 91, and when the direction of the separation of the recording material P from the transfer roller 6 is controlled to be close to the photosensitive drum 1, as in this embodiment, it is possible to prevent offset while still applying a low voltage. There is also the advantage that since the application of a constant voltage to the heating roller 91, regardless of the potential of the recording material P, prevents the adhesion of invisible toner other than fixing ghost, toner stains do not easily adhere to the heating roller 91, the pressure roller 92, the thermistor 94 or the separation claw 95, the latter two being in contact with the heating roller 91.

EMBODIMENT 3

Figure 10:
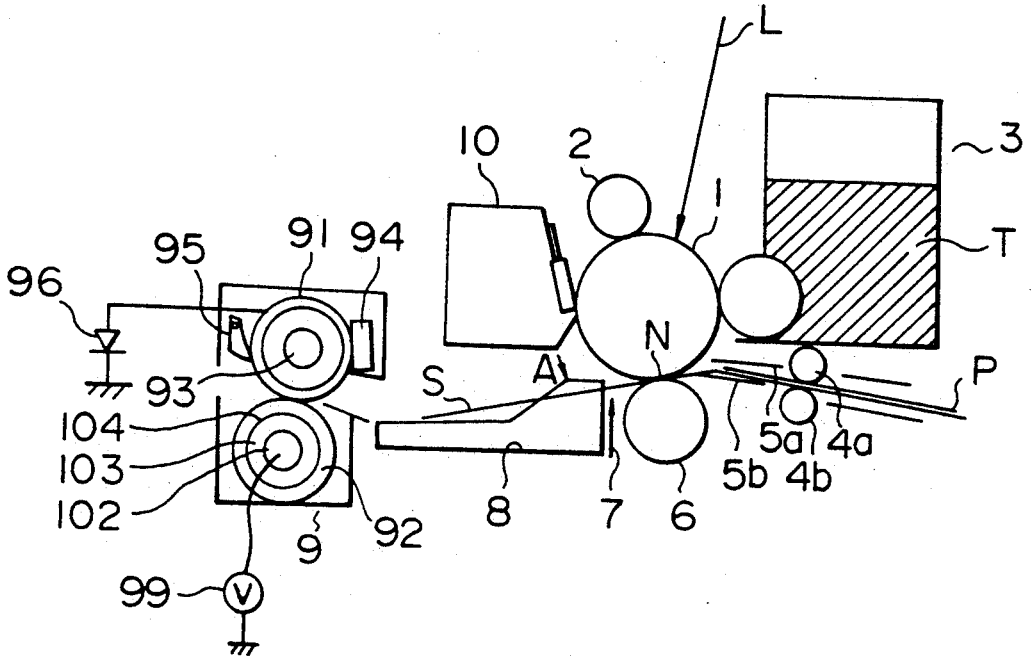
FIG. 10 is a schematic sectional view of a laser beam printer in accordance with a further embodiment of the present invention.

FIG. 10 is a schematic sectional view of a principal portion of a laser beam printer in accordance with a further embodiment of the present invention.

Since the construction and operation of the principal portions are the same as those of the first and second embodiments, they are not described below. This embodiment is characterized in that a voltage with polarity reverse to that of the toner used is applied to the pressure roller 92 by an electric power source 99. In this embodiment, the allowable range of the direction of the separation of the recording material P from the transfer roller 6 is wider than in the first and second embodiments. The pressure roller 92 comprises a metal core 102, a conductive silicone rubber layer 103 formed thereon and a PFA tube 104 coated to a thickness of 50 μm thereon. In this construction, the voltage applied to the metal core 102 of the pressure roller 92 acts on the recording material P through the PFA tube 104 having a thickness of 50 μm, substantially the entirety of voltage applied acts on the recording material P. In this case, the upper limit of the voltage applied is determined by a leakage toward the heating roller 91.

The investigation performed by the inventors showed that the upper limit is about +1 KV.

Figure 11:
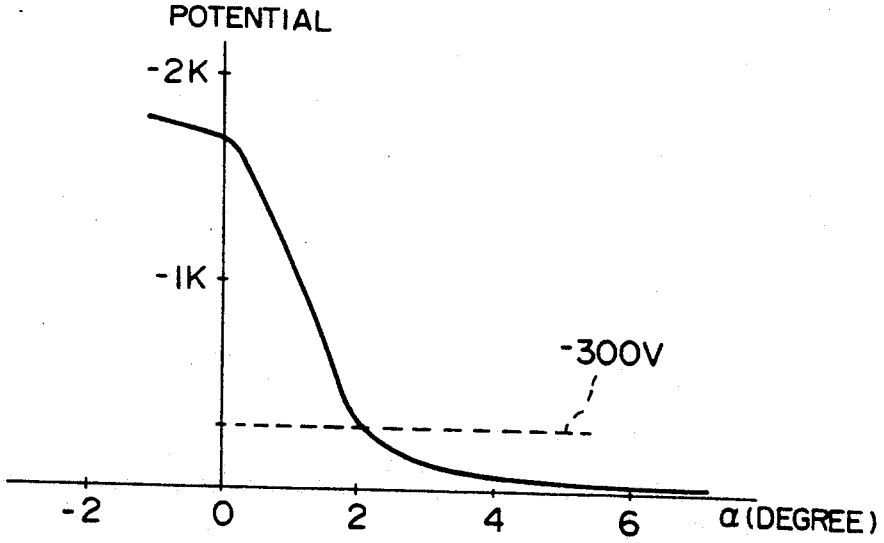
FIG. 11 is a graph showing the relation between the direction of separation of a recording material and the potential induced in a heating roller.

FIG. 11 is a graph showing the correlation between the direction α of separation of the recording material P (measured as a degrees from tangent S) and the potential induced in the heating roller 91 when a voltage of +800 V was applied to the pressure roller 92 in the same manner as that described above in the first embodiment with reference to the graph shown in FIG. 5. As seen from this graph, the potential induced in the heating roller 91 is lower than that in the first embodiment. This seems to be caused by the attractive force of the positive potential of the pressure roller 92. The potential induced in the heating roller 91 and required for preventing offset is −300 V or less which is the same as that in the first embodiment. This is because if the potential is −300 V or less, the leakage current of the diode 96 is extremely low, and the potential induced in the heating roller 91 is substantially equal to that generated in the recording material P, thereby inactivating an electrical field in the direction in which the toner adheres to the heating roller 91. As a result, it is preferable that the angle α between the tangent S and the direction of the separation of the recording material P from the transfer roller 6 is at least 2°.

Although each of the above embodiments concerns a laser beam printer as an image forming apparatus, the present invention can be applied to other types of image forming apparatuses such as an electrophotographic printer, an electrophotographic copying machine and an electrostatic recording apparatus, all of which use a transfer rotating member. Although, the specific embodiments described herein use a heating roller as a fixing device, a film-formed or belt-formed member (for example, comprising a polyimide film as a substrate and a conductive fluorine resin layer provided thereon to which a voltage is applied or which is earthed through a diode) can also be used as a fixing rotating member.

As described above, the present invention permits the control of the potential generated by the recording material after transfer, the prevention of offset when an OHP film or a high-resistance cardboard is used, and the removal of a cleaning member from a heat fixing device. The present invention also prevents the leakage phenomenon from occurring due to the voltage induced in a fixing rotating member or a pressure rotating member or the voltage applied thereto. In addition, since transfer charge is easily moved to the recording material, good transfer properties can be obtained for a high-resistance recording material.

While the present invention has been described with respect to what are presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus comprising:

an image supporting member on which a toner image is formed using toner;

a transfer rotating member forming a nip with said image supporting member, said transfer rotating member for electrostatically transferring a toner image formed on said image supporting member to a recording material;

fixing means for fixing said toner image to said recording material, said fixing means having a fixing rotating member which contacts said toner image on said recording material and to which a bias voltage with a same polarity as that of said toner is applied, and a pressure rotating member in pressure contact with said fixing rotating member to hold said recording material between said fixing rotating member and said pressure rotating member; and a guide member, having a top portion, for guiding said recording material so that an angle between a direction of separation of said recording material from said transfer rotating member, which is defined by a line connecting the center of said nip with an edge of the top portion of said guide member that is farthest from said image supporting member, and a line defined by a tangent of said image supporting member at the center of said nip is at least 2°, with the line defining the direction of separation being closer to said image supporting member than the line defined by said tangent, wherein the distance between said nip and said top portion edge is smaller than a length of the recording material.

2. An apparatus according to claim 1, wherein a diode is connected to said fixing rotating member in a direction to store charge having the same polarity as that of said toner.

3. An apparatus according to claim 2, wherein said diode has an electrostatic capacity of 100 pF or less.

4. An apparatus according to claim 1, further comprising an electrical power source, said electrical power source applying a bias voltage with the same polarity as that of said toner to said fixing rotating member.

5. An apparatus according to claim 1, further comprising an electric power source, said electric power source applying a bias voltage with a polarity reverse to that of said toner to said pressure rotating member.

6. An apparatus according to Claim 1, wherein said guide member comprises a high-resistance member contactable with said recording material and a conductive member provided near said recording material to ground said recording material.

7. An apparatus according to claim 1, wherein said image supporting member is a rotating member, and an angle between a vertical line extending through an axis of said image supporting member and a line connecting a center of said image supporting member with a center of said transfer rotating member is no grater than 60°.

8. An apparatus according to claim 7, wherein the angle between the vertical line and the line connecting the axis of said image supporting member and the axis of said transfer rotating member is no greater than 30°.

9. An image forming apparatus according to claim 1, wherein a voltage generating element for generating, in said fixing rotating member, a voltage with the same polarity as that of said toner by the fact that an electric current flows from said fixing rotating member to the ground is connected with said fixing rotating member.

10. An image forming apparatus comprising:

an image supporting member on which a toner image is forced using toner;

a transfer rotating member forming a nip with said image supporting member, said transfer rotating member for electrostatically transferring a toner image formed on said image supporting member to a recording material;

fixing means for fixing said toner image to said recording material, said fixing means having a fixing rotating member which contacts said toner image on said recording material and to which a bias voltage with a same polarity as that of said toner is applied, and a pressure rotating member in pressure contact with said fixing rotating member to hold said recording material between said fixing rotation member and said pressure rotating member; and a guide member for guiding said recording material so that an angle between a line defined by the direction of separation of said recording material from said transfer rotating member and a line defined by a tangent of said image supporting member at the center of said nip is at least 2°, with the line defined by the direction of separation being closer to said image supporting member than the line defined by said tangent, wherein said guide member comprises a high-resistance member contactable with said recording material and a conductive member provided near said recording material, sad conductive member being grounded.

* * * * *

UNITED STATES PATENT AND TRADEMARK OFFICE

CERTIFICATE OF CORRECTION

PATENT NO. : 5,285,245
DATED : February 8, 1994
INVENTOR(S) : MASAHIRO GOTO, ET AL.

It is certified that error appears in the above-indentified patent and that said Letters Patent is hereby corrected as shown below:

Column 10,
Line 17, "degrees" should read --degree--.

Column 12,
Line 9, "grater" should read --greater--;
Line 22, "forced" should read --formed--;
Line 35, "rotation" should read --rotating--; and
Line 50, "sad" should read --said--.

Signed and Sealed this

Ninth Day of August, 1994

Bruce Lehman

*Attest:*

BRUCE LEHMAN

*Attesting Officer*

*Commissioner of Patents and Trademarks*